US006465764B1

(12) United States Patent
Shahin

(10) Patent No.: US 6,465,764 B1
(45) Date of Patent: Oct. 15, 2002

(54) WATER HEATER AND CONTROL SYSTEM THEREFOR

(75) Inventor: Nabil Othman Shahin, Nashville, TN (US)

(73) Assignee: State Industries, Inc., Ashland City, TN (US)

( * ) Notice: Subject to any disclaimer, the term of this patent is extended or adjusted under 35 U.S.C. 154(b) by 0 days.

(21) Appl. No.: 09/651,158

(22) Filed: Aug. 30, 2000

(51) Int. Cl.[7] ..... H05B 1/02

(52) U.S. Cl. ..... 219/486; 219/483; 219/508; 219/519; 392/449; 392/454

(58) Field of Search ..... 219/411–413, 494, 219/501, 508, 519, 497; 392/450, 449, 454; 324/73 R, 505, 547

(56) References Cited

U.S. PATENT DOCUMENTS 4,833,398 A * 5/1989 Buchan ..... 219/509
5,442,157 A * 8/1995 Jackson ..... 219/492
5,808,277 A * 9/1998 Dosani et al. ..... 219/481
5,968,393 A * 10/1999 Demaline ..... 219/492
6,242,720 B1 * 6/2001 Wilson et al. ..... 219/486

* cited by examiner

*Primary Examiner*—Mark Paschall
(74) *Attorney, Agent, or Firm*—Michael Best & Friedrich LLP

(57) ABSTRACT

A water heater having a water tight tank (10) with a cold water inlet (14) and a hot water outlet (16). First and second heating elements (24, 26) are mounted in the upper and lower portions of the tank (10). A controller is provided for energizing element (24) to heat water in the upper portion of tank (10) until the temperature of the water in the upper portion of tank (10) reaches a preset temperature, at which time, the element (24) will be de-energized. The controller is adapted to energize element (26) when element (24) is de-energized. The controller is further adapted to de-energize element (26) and at the same time energize element (24) when the temperature of the water in the lower portion of the tank reaches a preset temperature.

14 Claims, 1 Drawing Sheet

WATER HEATER AND CONTROL SYSTEM THEREFOR

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

This invention relates to an electric water heater and more particularly to a control system for an electric water heater having an upper and a lower heating element.

BRIEF SUMMARY OF THE INVENTION

The water heater control system operates to cycle the energization of the upper and lower heating elements. The upper element is initially energized to heat the water in the upper portion of the tank to a predetermined set temperature at which time the upper element will be de-energized and the lower element will be energized. The lower element then heats the water in the lower portion of the tank to a predetermined set temperature, at which time the lower element will be de-energized and the upper element will again be energized. The sequence of heating the water in the upper and lower portions of the tank is then repeated.

Another feature of the control system is the prevention of a "dry fire " condition, i.e., energization of the heating elements without water in the water heater tank.

DETAILED DESCRIPTION OF THE INVENTION

Figure 1:
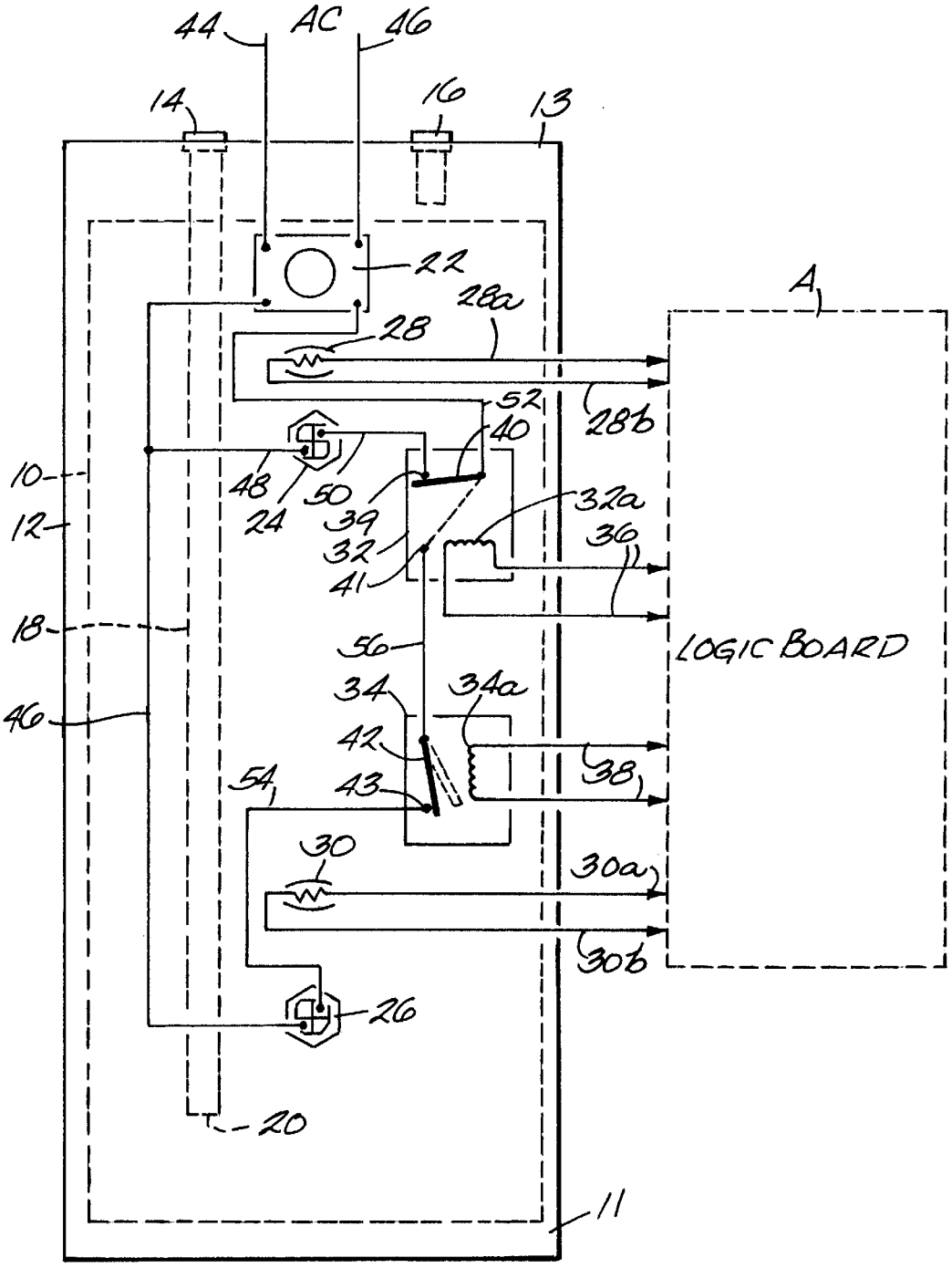
FIG. 1 is a partially schematic/wiring diagram for the programmable control for electric water heater of the present invention.

Referring to FIG. 1, the electric water heater of the present invention is comprised of a water tank 10, a tank jacket 12, a tank jacket base 11 and a jacket top 13.

The water heater tank 10 has a cold water inlet 14 and a hot water outlet 16, both mounted in jacket top 13. A dip tube 18 connected to cold water inlet 14 extends downwardly inside tank 10 to the open outlet end 20 of the dip tube 18. In use when heated water is drawn out of the top portion of the tank 10 through outlet 16, cold water will be simultaneously drawn into the tank through inlet 14 and dip tube 18. Cold water flowing downwardly through dip tube 18 will flow out open outlet end 20 of the dip tube into the lower portion of the water heater tank 10.

The control circuitry and control components for the water heater are shown in FIG. 1. The control includes an energy cut-off device of conventional design 22, an upper heating element 24 and a lower heating element 26 mounted inside tank 10. Upper and lower heat sensors 28, 30 are mounted on the outer surface of tank 10. Relays 32, 34 are provided for controlling the on-off energization of heating elements 24, 26. Relays 32, 34 are mounted exteriorly of the water heater tank.

A 240 VAC to 24 VAC step-down transformer (not shown) is mounted exteriorly of the water heater tank. In a preferred embodiment, the step-down transformer provides 240 volts AC to heating elements 24 and 25 under the control of relays 32 and 34.

Relay 32 has a winding 32*a* and a movable switch arm 40. When winding 32*a* is de-energized, arm 40 will be in contact with contact 39 and when winding 32*a* is energized, arm 40 will be moved out of contact with contact 39 and into contact with contact 41.

Relay 34 has a winding 34*a* and a movable switch arm 42. When winding 34*a* is de-energized, arm 42 will be in contact with contact 43. When winding 34*a* is energized, arm 42 will be moved out of contact with contact 43.

Conductors 36, 36 carry 24 volts AC from the step-down transformer to winding 32*a* of relay 32 through control unit A.

Conductors 38, 38 carry 24 volts AC from the step-down transformer to winding 34*a* of relay 34 through control unit B. Relay 32 has a normally closed movable switch arm 40 and relay 34 has a normal open switch arm 42.

Energy cut-off device 22 receives 240 volts AC through conductors 44, 44. The 240 volts AC fed into energy cut-off unit 22 is fed to heating units 24, 26 through conductors 46, 48.

The 240 volts AC fed to heating unit 24 is fed back to energy cut-off unit 22 through conductor 50, relay switch arm 40 and conductor 52. The 240 volts AC fed to heating unit 26 is fed back to energy cut-off unit 22 through conductor 54, relay switch arm 42, conductor 56, relay arm 40 and conductor 52.

OPERATION

A typical sequence of operation upon a call for heat in the water heater is as follows.

At the start of the sequence, relay switch arms 40, 42 will be in the positions shown in solid lines in FIG. 1.

With relay switch arm 40 in the FIG. 1 position, upper heating element 24 will be energized. When the water in the upper portion of tank 10 heats to 120° F. (or some other temperature setting), sensor 28 will actuate control unit A, which, in turn, will energize winding 32*a* of relay 32. The energization of winding 32*a* will move relay switch arm 40 from contact with contact 39 (solid line) into contact with control 41 (dotted line) to thereby de-energize element 24. The movement of switch arm 40 into contact with contact 41 will electrically connect conductors 52 and 56 to each other, thus causing heating element 26 in the lower portion of the tank to be energized.

Lower sensor 30 will then take over control of the water heater as lower element 26 heats the water in the lower portion of tank 10.

When the water temperature in the lower portion of tank 10 reaches 120° F., sensor 30 will signal control unit A to energize winding 34*a* of relay 34 to thereby move switch arm 42 to its open position (shown in dotted lines). Heating element 26 will thereby be de-energized. Also, when winding 34*a* of relay 32 is energized, control unit A will operate to de-energize winding 32*a* of relay 32. This will allow switch arm 40 of relay 32 to move back into contact with contact 39 to thereby energize heating element 24.

When the water temperature in the lower portion of the tank falls below 120° F., control unit A will de-energize winding 34*a* of relay 34 to thereby allow switch arm 42 of relay 34 to be returned to the FIG. 1 solid line position. The heating sequence described above will then be repeated.

Another feature of the subject control system described above is the prevention of a "dry fire " condition, Le., energization of the heating elements 24, 26 without water in tank 10. This is a condition that may occur upon original installation of the water heater wherein the installer inadvertently fails to fill tank 10 with water before connecting the water heater to a source of electrical energy.

If, for example, upon the initiation of the heating cycle described above, the temperature sensed by sensors 28, 30 increases at a rate greater than 3° F. per minute, control units A and B will operate to open relays 32, 34 to thereby shut off current to elements 24, 26.

While the invention herein has been shown and described in what is presently conceived to be the most practical preferred embodiment, it will be obvious to one of ordinary skill in the art that many modifications may be made thereof within the scope of the invention, which scope is not to be limited except by the appended claims.

I claim:

1. A water heater comprising:

(1) a water-tight tank (10);

(2) said tank (10) having a cold water inlet (14) and a hot water outlet (16);

(3) a first electrical heating element (24) mounted in an upper portion of said tank (10);

(4) a second electrical heating element (26) mounted in a lower portion of said tank (10);

(5) a first temperature sensor element (28) mounted on the outer surface of said tank (10);

(6) a second temperature sensor element (30) mounted on the outer surface of said tank (10);

(7) a first relay (32) mounted outside of said tank (10) having a first switch arm (40) and a winding (32*a*), said first switch arm (40) movable between a first position and a second position;

(8) a second relay (34) mounted outside said tank (10) having a second switch arm (42) and a winding (34*a*), said second switch arm (42) movable between a first closed position and a second open position;

(9) a source of high AC voltage connected to said first (24) and second (26) heating elements;

(10) a source of low AC voltage connected to said windings (32*a* and 34*a*) of said first and second relays (32, 34) respectively; and

(11) an electrical control unit (A) electrically connected to said first temperature sensor element (28) and said first relay winding (32*a*), said control unit (A) also connected to said second temperature sensor element (30) and said second relay winding (34*a*);

(12) said first relay (32) adapted to energize said first electrical heating element (24) when said first relay winding (32*a*) is in a de-energized condition;

(13) said first electrical heating element (24) adapted to actuate said control unit (A) to thereby de-energize said first electrical heating element (24) when the water in the upper portion of said tank (10) reaches a preset temperature;

(14) said first relay (32) is further adapted to energize said second electrical heating element (26) when said first arm (40) of said relay is actuated to move from its first position to its second position; and

(15) said second temperature sensor element (30) adapted to actuate said control unit (A) to energize said second relay winding (34*a*) of relay (34) to thereby move said second switch arm (42) to its open position to thereby de-energize said second electrical heating element (26) when the temperature in the lower portion of the tank reaches said preset temperature;

wherein said control unit (A) is adapted to sense a temperature rise in the tank (10) at an abnormally high rate, at which time the control unit (A) will operate to open said first and second relays (32, 34) to thereby shut off current to said first and second electrical heating elements (24, 26).

2. A water heater according to claim 1 in which said high AC voltage is 240 volts AC and said low AC voltage is 24 volts AC.

3. A water heater according to claim 1 in which said preset temperature is 120° F.

4. A water heater according to claim 1 in which the abnormally high rate is 3° F. or greater per minute.

5. A water heater comprising:

(1) a water tight tank (10);

(2) said tank (10) having a cold water inlet (14) and a hot water outlet (16);

(3) a first electrical heating element (24) mounted in an upper portion of said tank (10);

(4) a second electrical heating element (26) mounted in a lower portion of said tank (10);

(5) control means adapted for energizing said first electrical heating element (24) to heat water in the upper portion of said tank (10) until the temperature of the water in the upper portion of said tank (10) reaches a preset temperature, at which time said first electrical heating element (24) will be de-energized and said second electrical heating element (26) will be energized, said control means further adapted to de-energize said second electrical heating element (26) and at the same time energize said first electrical heating element (24), when the temperature of the water in the lower portion of the tank (10) reaches said preset temperature;

wherein said control means is adapted to sense a temperature rise in the tank (10) at an abnormally high rate, at which time the control means will operate to shut off current to said first and second electrical heating elements (24, 26).

6. A water heater according to claim 5 in which said control means includes a first temperature sensor (28) mounted in the upper portion of said tank (10) and a second temperature sensor (30) mounted in the lower portion of said tank (10).

7. A water heater according to claim 6 in which said control means further includes a control unit (A) controlled alternately by said first temperature sensor (28) and said second temperature sensor (30).

8. A water heater according to claim 7 in which said control means further includes a pair of relays (32, 34) controlled by control unit (A).

9. A water heater according to claim 7 in which said relays (32, 34) control the energization and de-energization of said heating elements (24, 26) respectively.

10. A water heater according to claim 5 in which said preset temperature is 120° F.

11. A water heater according to claim 6 in which said control means includes a step-down transformer operable to supply said heating elements (24, 26) with a source of high AC voltage and further operable to supply said temperature sensors (28, 30) with a source of low AC voltage.

12. A water heater according to claim 11 in which said high AC voltage is 240 volts AC and said low AC voltage is 24 volts AC.

13. A water heater according to claim 9 in which said abnormally high rate is 3° F. or greater per minute.

14. A water heater comprising:

(1) a water-tight tank (10);

(2) said tank (10) having a cold water inlet (14) and a hot water outlet (16);

(3) a first electrical heating element (24) mounted in an upper portion of said tank (10);

(4) a second electrical heating element (26) mounted in a lower portion of said tank (10);

(5) a first temperature sensor element (28) for sensing the water temperature in the upper portion of said tank (10);

(6) a second temperature sensor element (30) for sensing the water temperature in the lower portion of tank (10);

(7) a first relay (32) for controlling the energization and de-energization of said first temperature sensor element (28);

(8) a second relay (34) for controlling the energization and de-energization of said second temperature sensor element (30);

(9) an electrical control unit (A) operable in response to electric signals from said first and second temperature sensor elements (28, 30), said control unit (A) operable to cycle the operation of said first and second relays (32, 34) to thereby cycle the energization and de-energization of first and second temperature sensor elements (28, 30);

wherein said control unit (A) is adapted to sense a temperature rise in the tank (10) at an abnormally high rate, at which time the control unit (A) will operate to open said first and second relays (32, 34) to thereby shut off current to said first and second electrical heating elements (24, 26).

* * * * *